United States Patent [19]

Lannert et al.

[11] Patent Number: 4,614,374

[45] Date of Patent: Sep. 30, 1986

[54] RECESSED LATCH HOUSING

[75] Inventors: James W. Lannert, Oswego; James D. Sanders, Naperville; David K. Fowler, Aurora; Jerry G. Love, Plainfield, all of Ill.

[73] Assignee: Lyon Metal Products, Incorporated, Aurora, Ill.

[21] Appl. No.: 582,032

[22] Filed: Feb. 21, 1984

[51] Int. Cl.[4] ..... E05B 9/08

[52] U.S. Cl. ..... 292/337; 248/27.3; 292/DIG. 68; 312/242

[58] Field of Search ..... 292/337, DIG. 31, DIG. 68; 248/27.1, 27.3; 312/242, 245; 52/514; 49/463; 220/18, 3.8

[56] References Cited

U.S. PATENT DOCUMENTS

| | | | |
|---|---|---|---|
| 537,613 | 4/1895 | Lucas | 312/245 X |
| 2,000,241 | 5/1935 | Mangin | 248/27.1 |
| 2,104,523 | 1/1938 | Lichtenstein | 312/245 X |
| 2,304,144 | 12/1942 | Borchers | 292/DIG. 31 |
| 2,721,245 | 10/1955 | Arisman et al. | 248/27.3 X |
| 2,764,461 | 9/1956 | Montgomery | 312/245 X |
| 2,875,604 | 3/1959 | Fohn . | |
| 2,912,271 | 11/1959 | Schaefer . | |
| 2,946,640 | 7/1960 | Sitler . | |
| 3,210,457 | 10/1965 | Hancock et al. | 248/27.3 X |
| 3,278,145 | 10/1966 | Leshuk | 248/27.3 |
| 3,866,961 | 2/1975 | List . | |
| 4,063,660 | 12/1977 | Ware | 248/27.3 X |
| 4,077,693 | 3/1978 | Briel, Jr. et al. | 248/27.3 X |

FOREIGN PATENT DOCUMENTS

| | | | |
|---|---|---|---|
| 113463 | 7/1941 | Australia | 248/27.3 |
| 916918 | 9/1946 | France | 248/27.3 |
| 1059291 | 11/1953 | France | 292/337 |
| 1333655 | 6/1963 | France | 248/27.3 |

*Primary Examiner*—Gary L. Smith
*Assistant Examiner*—Lloyd A. Gall
*Attorney, Agent, or Firm*—Emrich & Dithmar

[57] ABSTRACT

The latch housing is made from a sheet of metal cut and bent to form a back wall and top and bottom and side walls which extend forwardly therefrom. The side walls diverge from each other so that the forward edges of the side walls are spaced apart a distance greater than the width of the opening in the door. The side walls are movable toward one another between the top and bottom walls to enable insertion of the housing into the opening. When mounted, the side walls extend between the top and bottom walls with their bottom edges overlying the upper surface of the bottom wall to conceal from view the space between the side walls and the bottom wall.

5 Claims, 8 Drawing Figures

RECESSED LATCH HOUSING

BACKGROUND OF THE INVENTION

This invention relates to latching mechanisms for doors of steel lockers, cabinets and the like, and more particularly to a latch housing adapted for mounting in an opening in the front surface of such door for defining a recessed area in which access is provided to a latching mechanism for the door.

Door handles and locks which protrude from the surface of locker doors can be dangerous to those moving in close proximity to the locker. This is a particular problem in school hallways, locker rooms or other areas of the school in which rough-housing may occur. Moreover, a locker having a protruding door handle can be easily jimmied enabling the locker to be forced open. The protruding door handle can be securely gripped and forced to move far enough to unlatch the locker door, even though the handle is supposedly locked in a fixed position.

To eliminate these problems, locker doors having recessed pulls have been proposed. With such arrangement, the door latch release mechanism, as well as the door lock are contained within a recessed pan and do not protrude from the surface of the locker. Since the door latch release is located within the top of the pan, the locker cannot be jimmied because there is no protruding handle which can be gripped to enable the door to be forced open.

Although the use of recessed pulls affords greater safety and security, providing such recessed pulls for locker doors results in increased cost both in manufacture and assembly of locker doors having recessed pulls. For example, assembly of the pan on the door may require welding or the pan may be installed using nuts and bolts or other hardware to securely attach the pan to the door. Either method results in increased labor costs.

SUMMARY OF THE INVENTION

It is an object of the invention to provide an improved door latch housing which is simple in structure and inexpensive to manufacture.

Another object of the invention is to provide a door latch housing which is readily mounted on the door and secured thereto without need for welding or the use of hardware.

The present invention achieves these and other objects by providing a box-like latch housing adapted for mounting in an opening in the front surface of a door, closing the opening and defining a recess in the front surface of the door in which access is provided to a latching mechanism for the door. The housing comprises a back wall, a pair of side walls and top and bottom walls, the top and bottom and side walls extending generally forwardly from the back wall, the side walls diverging from each other, and the forward edges of the walls defining an open front. The housing has an unstressed condition wherein the forward edges of the side walls are spaced apart a distance greater than the width of the opening in the door. The side walls are slightly movable toward one another between the top and bottom walls to enable insertion of the housing into the opening, the housing tending toward its unstressed condition wherein the forward edges of the side walls are adapted to bear against the sides of the opening. Thus, when the housing is mounted in the opening, the side walls extend between the top and bottom walls near the edges thereof with the bottom edges of the side walls overlying the upper surface of the bottom wall over substantially their entire length. This arrangement conceals from view the space in the corners between the side walls and the bottom wall when the corners are viewed from above the bottom wall.

In accordance with a feature of the invention, the latch housing is made from a flat sheet of metal with the back wall defined by a generally rectangular center portion of the sheet and the top, bottom and side walls being defined by portions extending from the four sides of the sheet and bent to extend generally forwardly of the back wall.

In accordance with another feature of the invention, the bottom wall of the housing has a notch formed therein at each corner, to receive the sides of the opening in the door when the housing is mounted therein, and a projection which extends from the top wall of the housing to engage the back side of the door above the opening to retain the housing in the opening.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF THE PREFERRED EMBODIMENT

Figure 1:
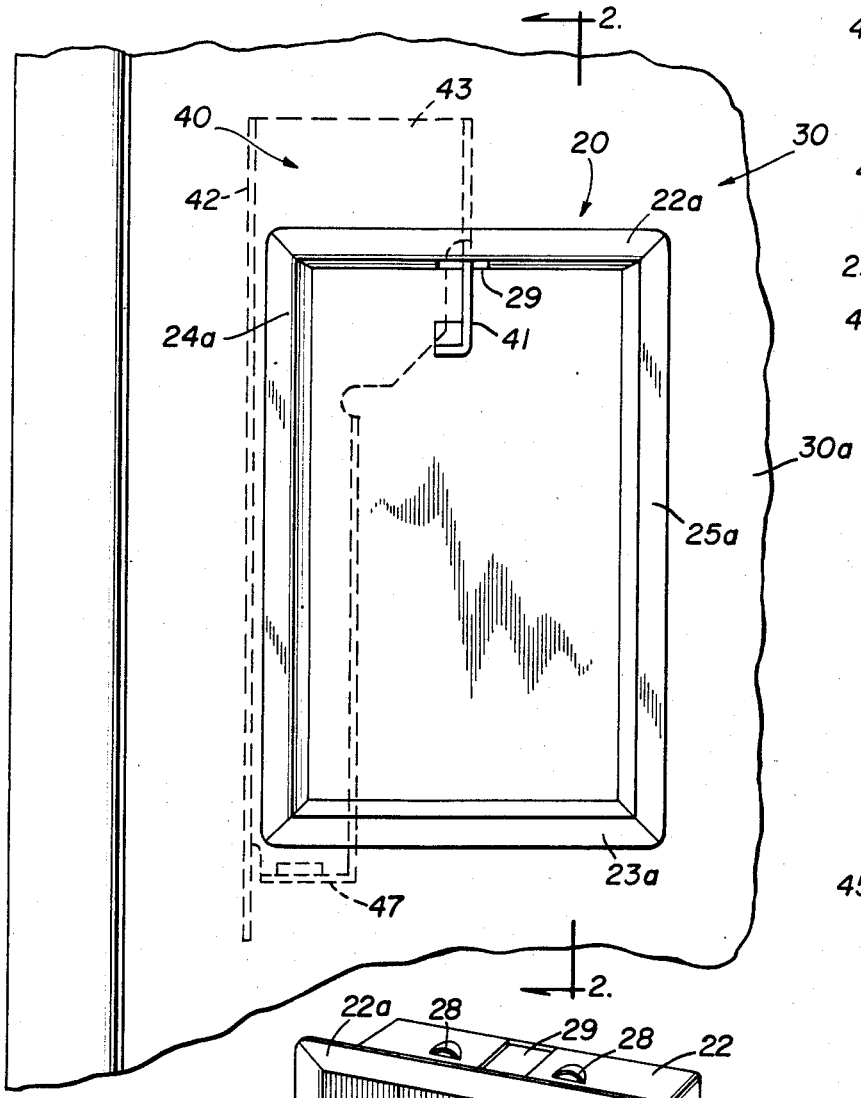
FIG. 1 is a fragmentary front elevational view illustrating the latch housing mounted in an opening in a door which is shown in a fragmentary view.
Figure 2:
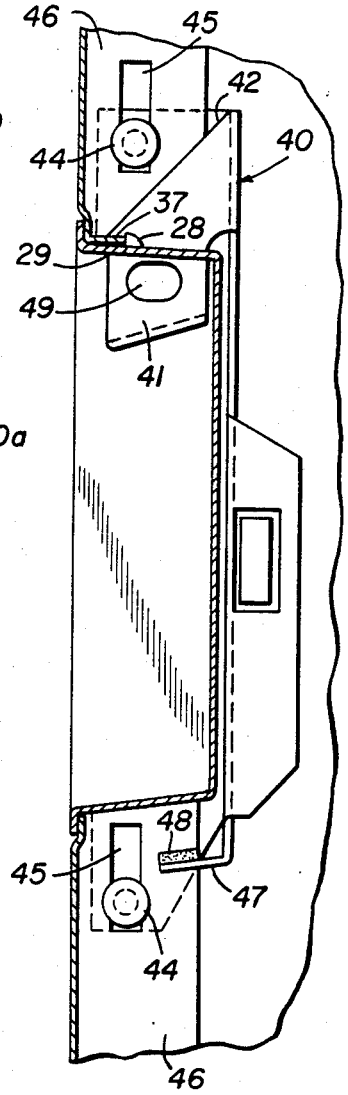
FIG. 2 is a fragmentary view in vertical section taken along the line 2—2 of FIG. 1.

Referring to FIGS. 1 and 2, a latch housing 20 embodying the principles of the invention is shown mounted in the front surface of a door 30. The latch housing 20 defines a recess in the front surface of the door in which access is provided to a latch bar 40 for the door. The assembly of the door, the latch housing and latch may be applied to a locker of the storage cabinet type frequently found in schools, gymnasiums and factories, etc.

The door 30 is of conventional form having a substantially flat front surface 30*a* with an opening 31 (FIG. 4) formed through the door adjacent to its unhinged edge for receiving the latch housing 20.

Figure 3:
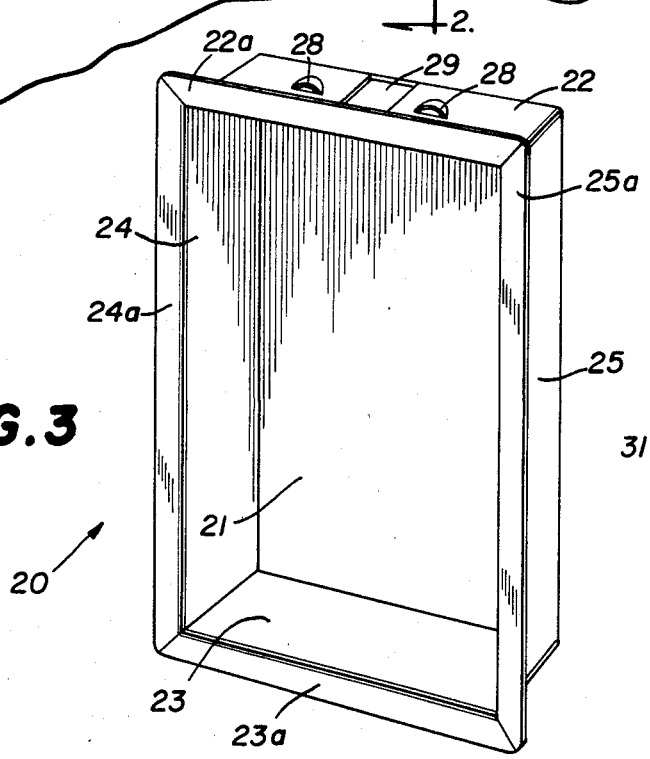
FIG. 3 is a perspective view of the latch housing.
Figure 5:
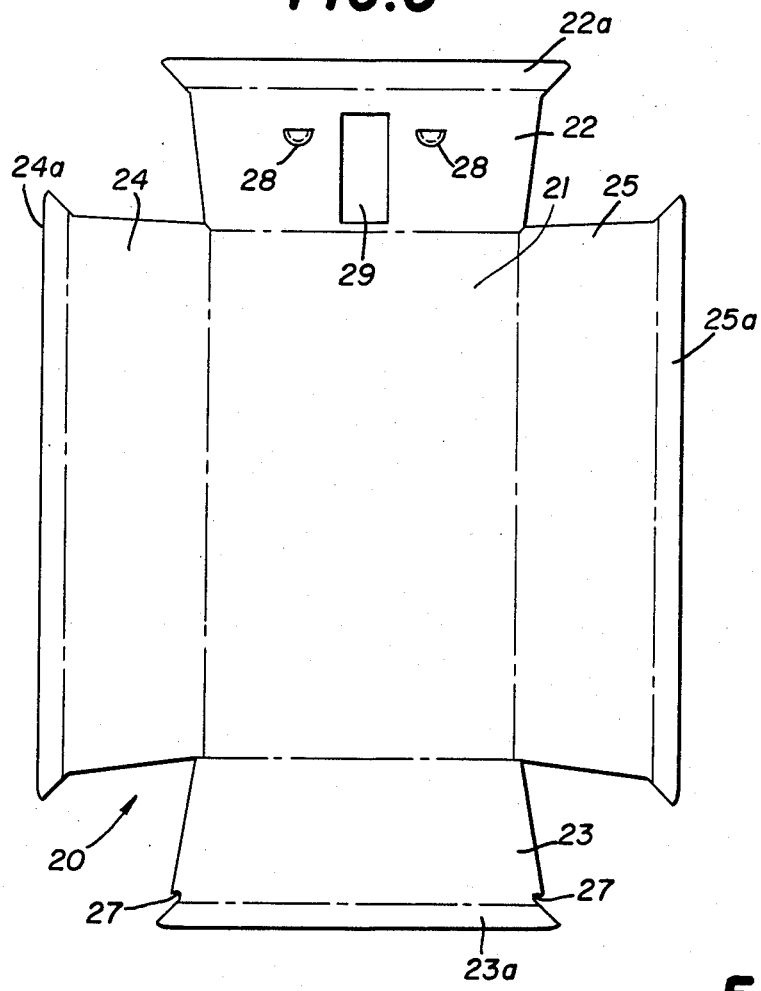
FIG. 5 is a view of the latch housing blank.

Referring to FIGS. 3 and 5, the latch housing 20 comprises a box-like structure having a quadrangular back wall 21, a top wall 22, a bottom wall 23 and a pair of side walls 24 and 25. The walls 22–25 extend generally forwardly from the back wall 21. The side walls 24 and 25 are forwardly divergent, as are the top and bottom walls 22 and 23 with respect to each other. The forward edges of the walls define an open front for the housing.

In accordance with the invention, the housing 20 is made from a flat sheet of metal with its four corners cut away as shown in FIG. 5. The top, bottom and side walls are defined by portions extending from the four sides of the quadrangular wall 21 as illustrated in FIG. 5. The four side portions are bent over to extend generally forwardly from the center portion of the sheet to define the box-like latch housing shown in FIG. 3.

The outer edges of the four walls are bent over, defining flanges 22*a*–25*a* at the front edge of each of the top, bottom and side walls. The flanges 22*a*–25*a* engage the outer surface of the door around the periphery of the opening when the housing is mounted in the opening to conceal the opening.

Figure 4:
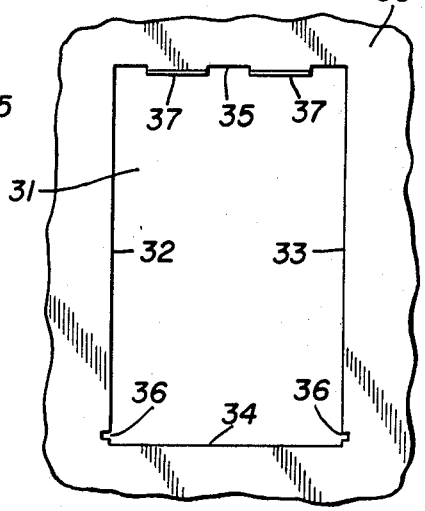
FIG. 4 is a fragmentary front elevational view of the door with the latch housing removed, illustrating details in the door opening.

As shown in FIGS. 3 and 5, the top, bottom and side walls are broader at their forward flange defining edge than at their rearward edge where they are attached to the center portion of the sheet. Prior to mounting in the door, the housing 20 has an unstressed condition wherein the forward edges of the side walls are spaced apart a distance greater than the width of the opening in the door between the side edges 32 and 33 thereof (FIG. 4). The side walls 24 and 25 are slightly movable toward one another between the top and bottom walls to enable insertion of the housing into the opening.

When the housing 20 is mounted in the opening 31 in the door as shown in FIG. 1, the housing tends toward its unstressed condition so that the forward edges of the side walls bear against the sides of the opening. The side walls 24–25 extend between the top wall 22 and the bottom wall 23 near the edges thereof with the bottom edges of the side walls overlying the upper surface of the bottom wall over substantially their entire length. Thus, the space in the corners between the side walls and the bottom wall is concealed from view when the corners are viewed from above the bottom wall.

Figure 7:
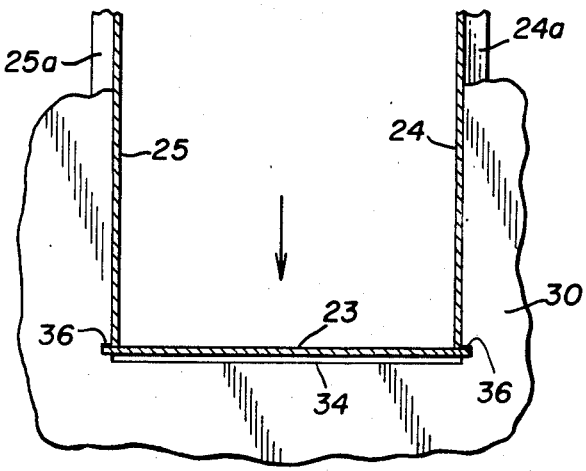
FIG. 7 is a view in vertical section taken along the line 7—7 of FIG. 6.

Referring to FIG. 4, each of the side walls 32 and 33 of the door opening 31 is provided with a notch 36 adjacent to the end 34. The notches 36 receive the broader edge of the bottom wall 23 during insertion of the housing 20 into the opening 31 (FIG. 7). Notches 27 are provided in the sides of the bottom wall 23 at the front ends thereof (FIG. 5). When the housing 20 is inserted, the notches 27 are aligned with the receive the side walls 32 and 33 near the lower ends thereof. The housing 20 is then urged downwardly until the wall 23 is seated on the end 34.

Referring to FIGS. 3 and 4, the top wall 22 has a pair of upwardly extending dimples or projections 28 formed therein. The dimples 28 provide detents which engage a pair of rearwardly extending tabs 37 formed in the top edge 35 of the opening 31. When the housing 20 is mounted in the door, as shown in FIG. 2, the dimples 28 are located behind the tabs 37 in frictional engagement therewith to retain the housing in the opening and to draw the flanges 22*a*–25*a* into engagement with the front surface of the door adjacent to the opening. Although no separate fasteners are used, it is a feature of the present invention that the housing 20 can not be removed when the door 30 is closed. To remove the housing, the dimples 28 must be forced down. This can only be done when the locker door is open.

The top wall 22 has a generally rectangular cutout 29 through which extends an end or trigger portion 41 of the latch bar 40, as shown in FIGS. 1 and 2 to be accessible by the user. The bar 40, which is in the form of an L-shaped member, has a vertically extending side portion 42 and a back portion 43 conforming in shape to the back corner of the housing. The side portion 42 of the bar 40 carries a pair of guides 44 which ride in tracks 45 formed in a vertically extending rail 46 provided in the back surface of the door, adjacent to its unhinged side.

The back portion 43 of the bar 40 has a generally triangular-shaped extension projecting forwardly therefrom parallel to and spaced from the side portion with the trigger portion 41, formed integrally therewith, shown best in FIG. 2, extending downwardly at the top center of the housing, and through the opening 29 in the top wall of the housing.

The latch bar 40 is mechanically linked to a door latching mechanism (not shown) which may be conventional in form and normally latches the door in a closed position, but is released responsive to movement of the latch bar 40 upwardly, enabling the door to swing freely to its open position. As shown in FIG. 1, the bottom edge of the trigger is bent over, defining a broader finger bearing surface which is more easily engageable by the index finger of the user during unlatching of the door. The back portion 43 of the latch bar 40 defines a tab 47 carrying a bumper 48 of resilient material, such as rubber. The bumper is interposed between the bottom of the housing and the latch member to eliminate noise as the latch bar is moved upwardly, during unlatching of the door. A further bumper carrying tab (not shown) is interposed between the top of the housing and the latch member to eliminate noise as the latch bar is allowed to fall to its normal resting position.

The trigger portion 41 has an opening 49 to receive the shank of a padlock (not shown) for locking the latch mechanism in place. As can be seen in FIGS. 1 and 2, the recess defined by the housing 20 provides sufficient space to contain such lock so that the lock, while accesible when the locker is to be unlocked, will not protrude beyond the surface of the door.

Figure 6:
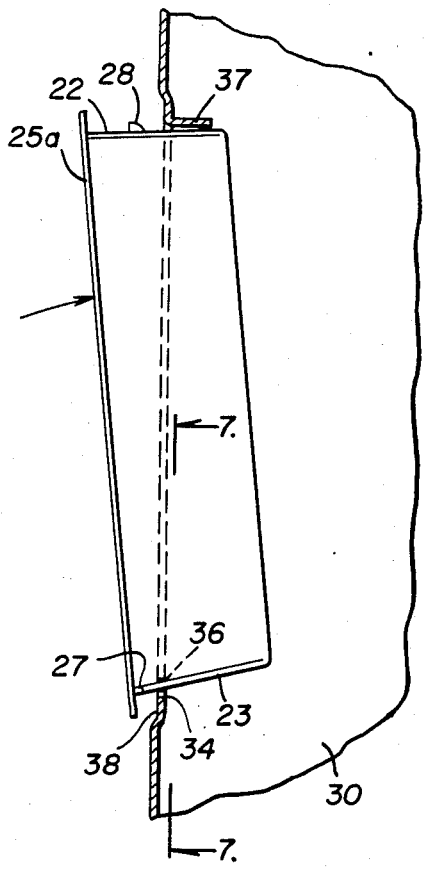
FIG. 6 is a side fragmentary view, partially in section, showing the latch housing being inserted into the opening in the door.
Figure 8:
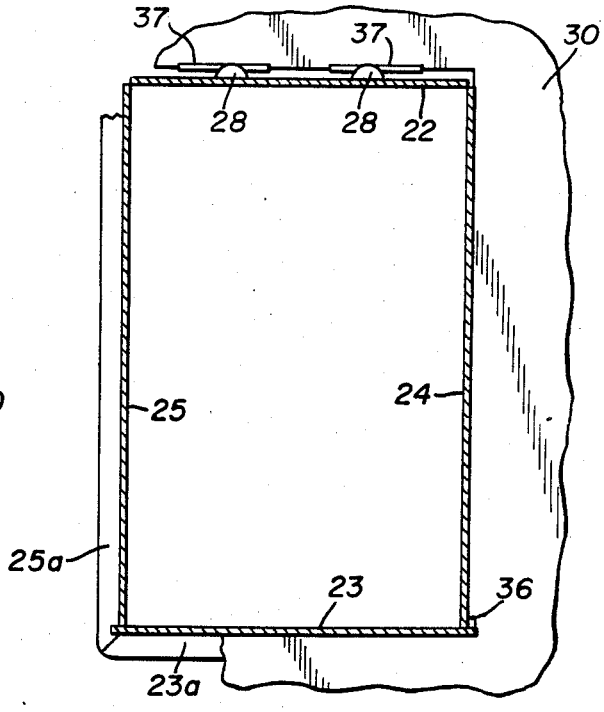
FIG. 8 is a fragmented back view, partially in section, illustrating the latch housing after being mounted in the opening in the door.

Referring to FIGS. 6–8, in mounting the housing 20 in the door 30, the housing is initially in an unstressed condition wherein the forward edges of the side walls are spaced apart a distance greater than the width of the opening in the door. The bottom edge of the housing is inserted first with the top edge of the housing being tilted forwardly, as illustrated in FIG. 6. The bottom edge of the housing is moved inwardly until the notches 27 in the front corners of the bottom wall engage the sides of the opening as shown in FIG. 7. As the housing is being inserted into the opening, the side walls 24 and 25 are moved slightly toward one another between the top and bottom walls 22 and 23 to enable insertion of the housing into the opening.

After insertion of the bottom edge, the housing is pushed downward, in the direction of the arrow in FIG. 7, and pivoted about its bottom edge, in the direction of the arrow shown in FIG. 6. The housing is pushed into the opening where it is retained by the dimples 28 which deflect and engage behind the tabs 37 on the back surface of the door above the opening as shown in FIG. 8. When mounted in the opening, the housing tends toward its unstressed condition so that the forward edges of the side walls 24 and 25 bear against the sides of the opening.

When the housing 20 is mounted in the opening 31, the side walls 24 and 25 extend between the top wall 22 and the bottom wall 23 near the edges thereof with the bottom edges of the side walls overlying the upper surface of the bottom wall over substantially their entire length. This conceals from the view the space in the corners between the side walls and the bottom wall when the corners are viewed from above the bottom wall.

The combination of the notches 27 formed in the forward portion of the bottom wall and the dimples 28 extending upwardly from the top wall and cooperating with the tabs 37 formed on the door inner surface retain the latch housing 20 in the door without need for hardware, welding or similar means.

We claim:

1. In a door assembly, the combination comprising a door having an opening in its front surface, a latching mechanism attached to the back side of the door, and a box-like latch housing mounted in said opening, closing said opening and defining a recess in said front surface of said door in which access is provided for said latching mechanism, said housing including a closed end defined by a back wall, and an open end defined by the edges of top and bottom walls and a pair of side walls, said housing having a peripheral flange defined by edges of its top and bottom and side walls at its open end, said flange engaging said outer surface of said door around the periphery of said opening so as to conceal said opening, said bottom wall having notches formed therein, one at each corner adjacent to its flange defining edge, the side edges of said opening in said door being received in the notches in said bottom wall, the upper edge of said opening defining a tab at the back side of said door extending rearwardly and above said opening, and said top wall having at least one upwardly extending projection which deflects and then frictionally engages behind said tab as said housing is mounted in said opening for securing said housing to said door.

2. The door assembly of claim 1, wherein the forward edge of at least said bottom wall is broader than said opening and the forward edges of said side walls are spaced apart a greater distance than the width of said opening, said door having a notch in each bottom corner of said opening to receive the broader forward edge of said housing, and said side walls being slightly movable toward one another between said top and bottom walls to enable insertion of said housing into said opening.

3. In a door assembly, the combination comprising a door having an opening in its front surface, and a box-like latch housing mounted in said opening, and defining a recess in said front surface of said door in which access is provided for a latching mechanism, said housing including a back wall, a pair of side walls and top and bottom walls, said top and bottom and side walls extending generally forwardly from said back wall with adjacent edges of said top wall and said side walls unconnected and adjacent edges of said bottom wall and said side walls unconnected, said side walls diverging from each other, the forward edges of said walls defining an open front for said housing, said housing having an unstressed condition prior to mounting in said opening wherein the forward edges of said side walls are spaced apart a distance greater than the width of said opening in said door, said side walls being slightly movable toward one another between said top and bottom walls defining a stressed condition for said housing during insertion of said housing into said opening, and said housing tending toward its unstressed condition when mounted in said opening wherein the forward edges of said side walls bear against the sides of said opening, whereby when said housing is mounted in said opening, said side walls extend between said top and bottom walls near the edges thereof maintaining said top and bottom walls in a spaced relationship with the bottom edges of said side walls overlying the upper surface of said bottom wall over substantially their entire length thereby concealing from view the space in the corners between said side walls and said bottom wall when the corners are viewed from above said bottom wall, peripheral flanges respectively at the front edge of each of said top and bottom and side walls, said flanges engaging the outer surface of said door around the periphery of said opening, concealing said opening, the forward edge of at least said bottom wall being broader than said opening, said door having a notch in each bottom corner of said opening to receive the broader forward edge of said bottom wall.

4. The door assembly of claim 3, wherein said bottom wall of said housing has notches formed therein, one at each corner of its front edge, the side edges of said opening being received in the notches in said bottom wall.

5. The door assembly of claim 3, wherein the upper edge of said opening defines a tab at the back side of said door extending rearwardly and above said opening, and said top wall has at least one projection which deflects and then frictionally engages behind said tab as said housing is mounted in said opening to retain said housing in said opening.

* * * * *